United States Patent [19]

Breckenridge

[11] Patent Number: 4,972,604

[45] Date of Patent: Nov. 27, 1990

[54] METHOD AND APPARATUS FOR REGULATING DRYING KILN AIR FLOW

[76] Inventor: Leon Breckenridge, 1310 S. 16th Ave., Yakima, Wash. 98902

[21] Appl. No.: 265,253

[22] Filed: Oct. 31, 1988

[51] Int. Cl.[5] ..... F26B 5/00

[52] U.S. Cl. ..... 34/34; 34/231

[58] Field of Search ..... 34/231, 226, 50, 46, 34/47, 34, 22

[56] References Cited

U.S. PATENT DOCUMENTS 1,432,248 10/1922 Hirt .
1,919,646 7/1933 Woolhouse ..... 34/231 X
3,196,554 7/1965 Smith ..... 34/231 X
4,599,808 7/1986 Gelineau et al. ..... 34/46 X

*Primary Examiner*—Albert J. Makay
*Assistant Examiner*—John Sollecito
*Attorney, Agent, or Firm*—Patrick Michael Dwyer

[57] ABSTRACT

A method and apparatus for regulating drying kiln airflow by disposing within drying kiln wall 1 one or more inflatable baffle bags, such as top bag 10, bottom bag 20, side bags 30, or end bags 40. Inflated baffle bags engage a stack of product 2 in such a way that drying airflow directed through the drying kiln flows through product stack 2, and not around it.

12 Claims, 3 Drawing Sheets

METHOD AND APPARATUS FOR REGULATING DRYING KILN AIR FLOW

TECHNICAL FIELD

This invention relates to the field of kilns used for drying various products, particularly ways and means of regulating the flow of drying air through such kiln; more particularly, the invention relates to an inflatible baffle bag air g baffling system for use in such drying kilns.

BACKGROUND OF THE INVENTION

Drying kilns are employed to dry and season a variety of products, particularly lumber. In the lumber industry drying kilns are employed to season green wood and partially air dried wood. Typically, an elongated structure is employed, currently between 60′ and 110′ long, in which one or more stacks of green lumber are arranged so that a flow of drying air may be directed over and through those stacks and thereby dry the lumber. Typically, fans are employed either to draw air via conventionally arranged ducting through the stack from one end thereof, or to force air through the stack through one side and out the other side and then recirculate the drying air back to the stack through further conventionally arranged ducting. State of the art systems employ both temperature and humidity controls associated with fan means and ducting to control the humidity and temperature of the drying air and to force it through or pull it through the stacks of green lumber until such time as the lumber has reached the desired degree of dryness.

The problem of directing the flow of drying air efficiently through and over the stack of green lumber has long begged a solution. Woolhouse (U.S. Pat. No. 1,919,646) discloses a curtain means 16 employed in such an attempt. One device disclosed in U.S. Pat. No. 3,196,554 to Smith discloses a series of supposedly inflatible baffles to serve much the same purpose as a series of Woolhouse's curtains for nonheated predrying. No known methods effectively baffle substantially all of the drying airflow from flowing around the product stack. Current methods of regulating airflow require considerable power consumption by the fan means since substantial amounts of drying airflow escape around the sides of the stacks of lumber and thus require wasted recirculation by the fans.

Current methods of baffling also require either uniform loads within a particular kiln or at least loads which do not vary significantly in surface dimension over the length of any particular side of the load. Even the baffles disclosed by Smith permit airflow to escape in a somewhat winding path around the edges of the various interwoven baffles therein disclosed, assuming that a Smith baffle could be made to inflate and effectively seal against the load surface at all.

It is essential that this drying operation be cost effective particularly in times when the lumber industry is troubled, and thus it is necessary to employ a standard sized kiln which can accomodate various sizes of stacked green loads of lumber.

DISCLOSURE OF THE INVENTION

Accordingly, it is an object of the invention to provide a system of air inflated baffle bags which provide a continuous seal around the surface of a green product load.

It is a further object of the invention to provide inflated baffle bags which can maintain effective sealing with non uniform load sizes for a particular kiln setup and which will also effectively seal irregularities in a load's surface of 2 feet or greater.

It is a further object of the invention to provide a means to seal one side or crib of a double crib kiln even when the other side is empty or only partially loaded.

It is another object of the invention to provide an inflatable sealing baffle system which will work with reversing high or low pressure fans in heated or unheated kilns and which can stand up to airflow in modern kilns which could otherwise effectively blow $2\times10$'s off the top of the load.

It is a further object of the invention to provide an inflatable top baffle bag which can transmit a uniform force to the top of the green product stack in the range of hundreds of pounds per square foot in order to help keep the lumber straight during drying.

It is still another object of the invention to provide an inflatible air baffling system which will reduce fan power requirements by up to 40 percent since virtually 100 percent of the air circulated flows directly through the product load.

These and other objects of the invention as disclosed herein are accomplished by the ways and means further described herein. The apparatus of the invention is a system of one or more inflatible air bags which can be disposed to surround top, bottom and sides of an end flowing kiln, or top, bottom and ends of a side flowing kiln, so that all drying airflow is forced fully through the green product load and substantially none of the drying air is permitted to go around the green product load.

In a preferred embodiment a separate bag is employed on each of four of the six surfaces of the typically rectilinear product stack. In an alternate embodiment, a kiln having two cribs separated by a central heating coil, and appropriately conventionally ducted, might employ baffle bags only at the top of a product stack in each crib with air forced through the sides of both stacks from the outside to be drawn upwardly then into the centrally located fan means. However, any inflatable bag arrangement, including a single continuous bag around one or more sides of the load, would also be within the scope of the invention. It will be appreciated however, by those skilled in the art, that baffle bag arrangements which provide for constraining less than all of the drying airflow are readily adaptable from the apparatus of the invention, simply by selectively under inflating, or not inflating at all, one or more of the bags disposed around the product stack.

The preferred bag material may be any durable, resilent, relatively inelastic material selected to resist prolonged periods of the heat and humidity as anticipated in any particular kiln application, and to last over thousands of inflation cycles. A material known as Shelter-Right XR-5 8130, available from Seaman Corporation, 1000 Ventura Boulevard, Wooster, Ohio 44691, has been found to be a suitable bag material. Each bag has its own conventionally arranged air inlet means together with a suitable conduit to a source of pressurizing or inflating air. This can be a separate blower selected to have a capacity for relatively quick bag inflation and to generate sufficient pressure inside the bag to generate the hundreds of pounds per square foot pressure needed in the top bag application as disclosed more particularly herein. However, ducting off from the same fans employed to circulate the drying airflow may also be used to inflate the air bags.

Each bag can be constructed in any conventional manner appropriate to the material selected for the bag and may be seamed or unseamed. A bag may have end panels and be made up from multiple panels of material conventionally seamed together, or may be a single piece of material and be seamed like a pillow. The length of the bag is typically chosen to be the length of the usual green product load, and the width of the bag selected to conform to the width, or as the case might be, the height of the kiln or, in multiple crib kilns, the height or width of the crib. End bags have dimensions similarly selected to accomodate the dimensions of the end of the kiln or crib, as the case might be. As principal variations in overall product load dimensions will be in the height of the load, the top bag is generally selected to be able to accomodate the widest distance between the top of a particular product load and the effective ceiling of the kiln's drying space. This effective ceiling is usually the fan deck because in conventional kilns the fan apparati all sit above the drying space. A preferred top bag can inflate to a maximum of 30 inches below the fan deck. A recommended minimum inflation of 10 inches below the fan deck should be employed so that product stacks should not be higher than within 10 inches of the fan deck. This allows for optimum uniformity of pressure inside the bag.

The apparatus of the invention also provides for a means to raise the deflated top bag material above the product load during the times when the product load is being placed into or out of the kiln drying area. A pair of syncronously turning pipe rollers are disposed one on either side of the top bag and preferably so linked together that they turn in opposite directions when they are rotated. Three inch lengths of conventional high temperature belting material are conventionally attached at each end of each length to one each of the pair of pipe rollers.

Each strap has a length sufficient to permit maximum inflation of the bag against the top of the product, and sufficient straps are employed along the lengths of the rollers to provide, in a preferred embodiment, approximately a three foot spacing between straps. Thus when the rollers are turned they each reel in a portion of the strap to raise the deflated bag material. Of course, other roller arrangements could be made to serve, including rollers turning in the same direction with appropriately offset strap mountings, or a single turning roller with the other end of the strap affixed to a stationary pipe or rail, without departing from the scope of the invention.

The method of the invention comprises the steps of (1) arranging within a conventional drying kiln having a stacked product load therein a system of inflatible baffle bags, preferably four bags, one for each of four of the six sides of a typical product load, each bag substantially the same dimensions as the respective dimensions of the side of the load to which it is assigned, and (2) inflating the baffle bag system with air from a source to create an inflation pressure within each bag sufficient to withstand the force of the drying airflow employed in the kiln and thus to effectively seal the bag material against the respective sides of the product load and against themselves and thereby prevent drying airflow from escaping around the product load.

BEST MODE OF ACCOMPLISHING THE INVENTION

Figure 1:
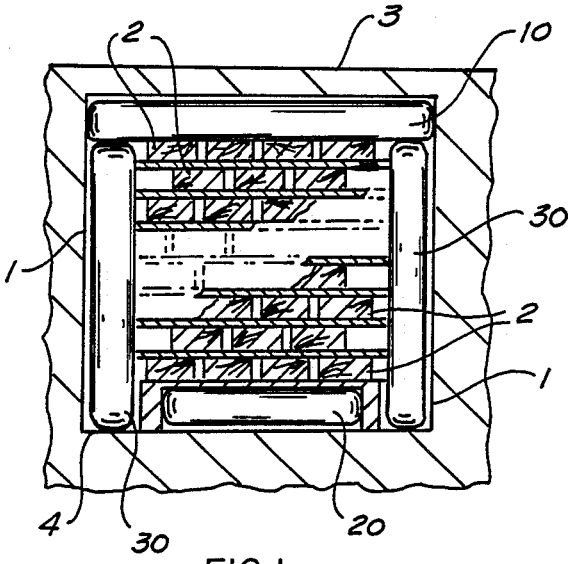
FIG. 1 is an end cross section of an embodiment of the invention

Referring now to the drawings wherein like numbers indicate like parts, an embodiment of the invention is depicted in FIG. 1. A drying kiln having walls 1, floor 4, fan deck 3, and a stack of product 2, is shown baffled for endwise airflow through product 2 by inflated top bag 10, bottom bag 20, and side bags 30. The pressure in each of the baffle bags may be independently regulated to achieve effective sealing of the bags against the respective surfaces of product 2 and, in the case of top baffle bag 10, to achieve optimal compression of product 2 by the uniform force exerted by inflated top bag 10 against the top of the stack of product 2.

Figure 2:
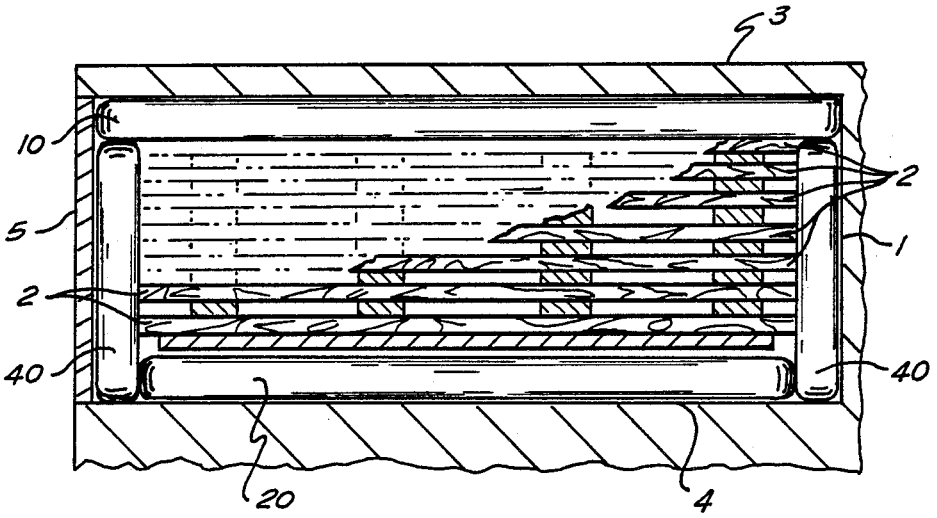
FIG. 2 is a side cross section of an alternate embodiment of the invention.

In FIG. 2 an alternate baffle bag arrangement is depicted which is optimized for drying airflow through the sides of the stack of product 2, instead of through the ends of the product stack as shown in FIG. 1. In a manner similar to that described for the embodiment shown in FIG. 1, top bag 10, bottom bag 20 and end bags 40 are inflated to seal the surfaces of product 2 and to provide compression on the top of product 2. In FIG. 2 product 2 has been loaded into the kiln through kiln door 5 and one of the end bags 40 is disposed to exert pressure against the end of the product stack 2 and kiln door 5.

Figure 3:
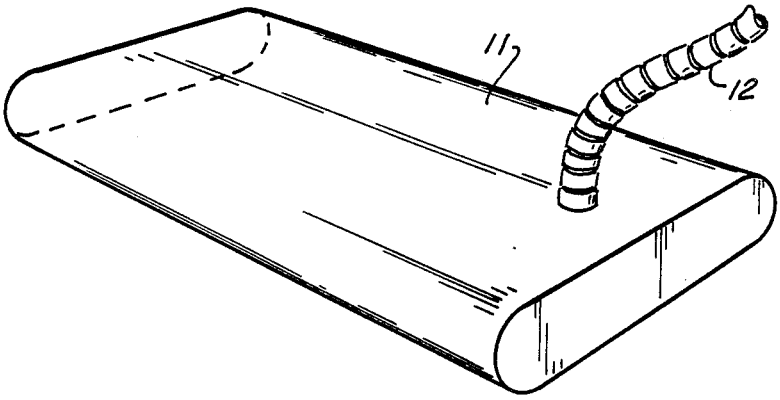
FIG. 3 is an isometric view of a typical baffle bag of the invention.

In FIG. 3 a typical baffle bag 11 is depicted showing the means by which the inflating air enters bag 11 through boot 12 from an air source (not shown).

Figure 4:
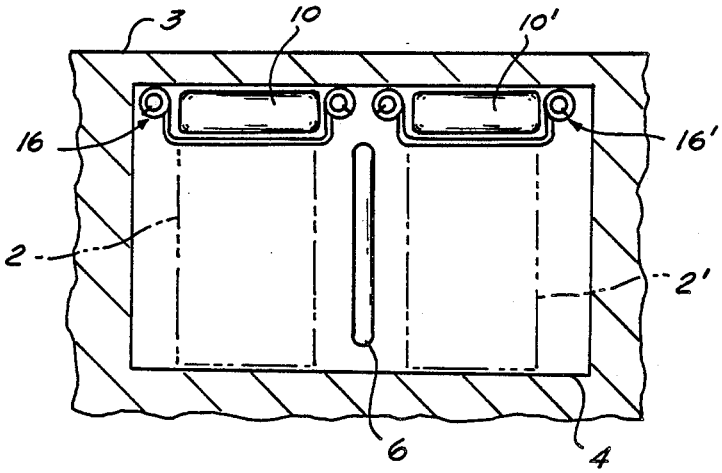
FIG. 4 is an end view of an alternate embodiment of the invention.

In FIG. 4 is depicted an alternative embodiment of the invention disposed within a double kiln. Two stacks of product 2 and 2' separated by center coil 6 are disposed within the kiln and are sealed at the top of each of said stacks by separate top bag 10 and 10'. Also depicted is bag raising means 16 and 16' for raising the material of top bag 10 and 10' away from the surface of the top of product stack 2 and 2' and toward fan deck 3 when said product is to be taken in or out of the kiln.

Figure 5:
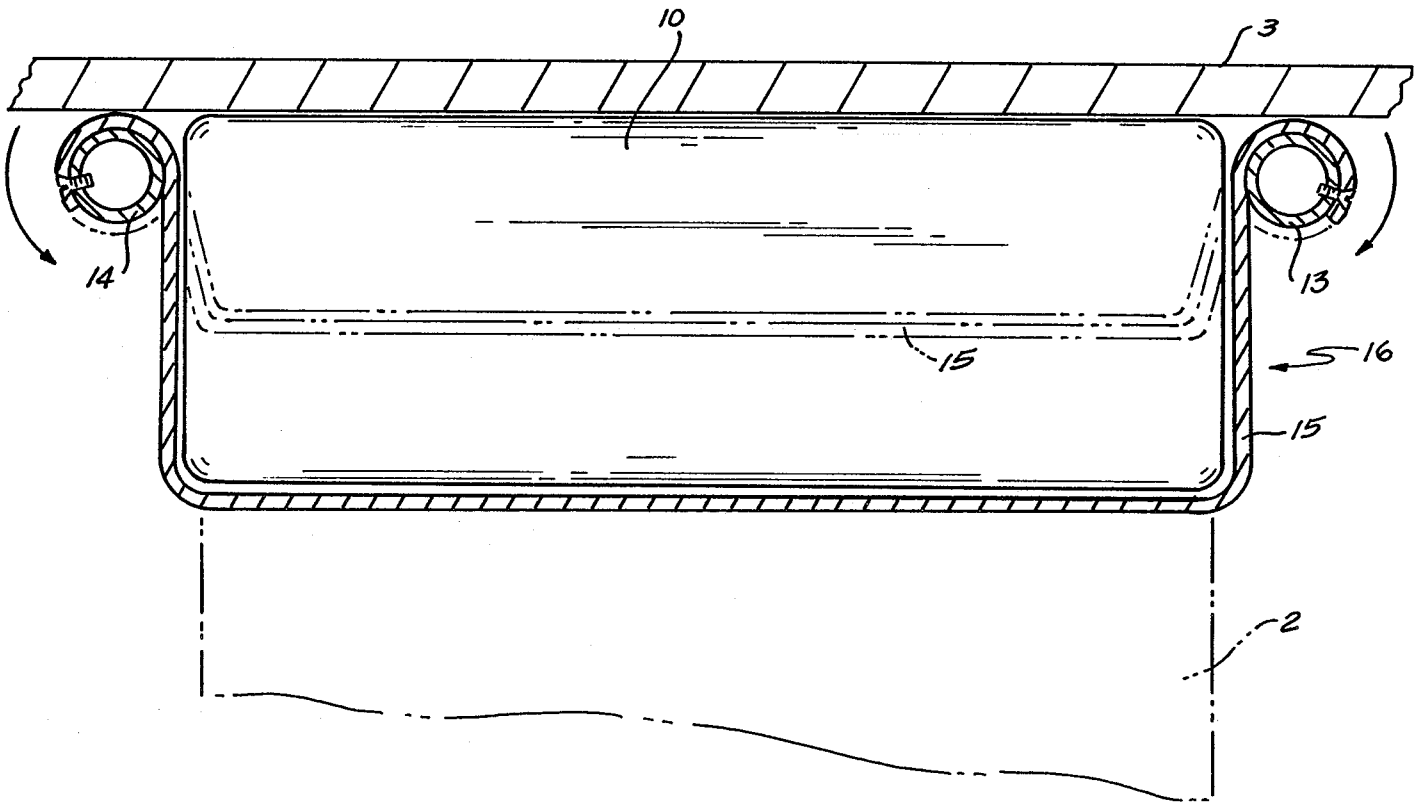
FIG. 5 is a detail of the bag raising mechanism 16 shown in FIG. 4.

In FIG. 5, bag raising means 16 is shown in detail. It is comprised of a pair of synchronously turning, but oppositely rotating roller shafts 13 and 14 to which is attached one or more lengths of strap 15 of sufficient length that when unwound, air bag 10 may fully inflate and exert pressure against product stack 2, but which when pulled up upon rollers 13 and 14 raises the material of bag 10 up toward fan deck 3. Rollers 13 and 14 are conventionally connected to suitable mechanical drive means such as electric motors or the like through pulleys, gears, chain drives or the like to achieve the required synchronous, but opposite, rotation. Alternately a weighted wire rope may be wrapped around one end of one of said interconnected pair of rollers for manual operation in a conventional fashion.

Preferably, a three inch strapping material is employed approximately every three feet along the length of shafts 13 and 14. Roller shafts 13 and 14 are preferably at least as long as bag 10 and a three to four inch diameter pipe has been found to be a suitable roller shaft material. The detail of the bag raising means 16 is shown in FIG. 5 with the deflated bag contour shown in broken lines.

In compliance with the statute, the invention has been described in language more or less specific as to structural features. It is to be understood, however, that the invention is not limited to the specific features shown, since the means and construction herein disclosed comprise the preferred form of putting the invention into effect. The invention is claimed in any of its forms or modifications within the legitimate and valid scope of the appended claims, appropriately interpreted in accordance with the doctrine of equivalents.

I claim:

1. A drying kiln for drying of product with an airflow comprising:

one or more inflatable baffle bags arranged within said kiln and disposed around said product so as to constrain said airflow to flow only through said product substantially from one end to the other; wherein at least one of said baffle bags is disposed to overlay substantially the entire top of said product, whereby inflation of said bag exerts a uniform pressure across substantially the entirety of said top.

2. The apparatus of claim 1 further comprising: means to raise the material of said top baffle bag when deflated.

3. The apparatus of claim 2 wherein said means to raise said top bag material comprises a pair of synchronously turning, oppositely rotating shafts, and a strap means, wherein said shafts serve to take up slack in said strap means to raise said material.

4. A method of directing a drying airflow in a drying kiln through a stack of product, said stack generally having top, bottom, end, and side stack surfaces, said method comprising the steps of:

(a) disposing within said kiln one or more inflatable baffle bags for engagement with said stack such that each said baffle bag engages, when inflated, substantially all of at least one of said stack surfaces;

(b) inflating said bags to a pressure sufficient to resist the force of said drying airflow against said bags so that said bags seal all surfaces of said stack with which said bags are engaged from substantial exposure to said airflow.

5. The method of claim 4 wherein one or more of said inflatable baffle bags engages substantially all of said top, bottom, and side stack surfaces.

6. The method of claim 5 wherein substantially all of said airflow is directed by said inflatable baffle bag through said stack.

7. A drying kiln for drying stacks of product with an airflow, each of said stack generally having top, bottom, end and side stack surfaces, comprising:

one or more inflatable baffle bags disposed within said kiln such that each said baffle bag engages, when inflated, substantially all of at least one of said stack surfaces.

8. The apparatus of claim 7 further comprising four inflatable baffle bags, one each engaging substantially all of said top, bottom, and two side surfaces respectively.

9. The apparatus of claim 7 further comprising four inflatable baffle bags, one each engaging substantially all of said top, bottom, and two end stack surfaces respectively.

10. The apparatus of claim 7 wherein one or more of said inflatable baffle bags are disposed within said kiln such that said baffle gabs, when inflated, engage, in their aggregate, substantially all of said top, bottom, and side stack surfaces.

11. The apparatus of claim 8 wherein inflation of said inflatable baffle bag engaging said top stack surface exerts a uniform pressure across substantially the entirely of said top stack surface.

12. The apparatus of claim 11 wherein said product is lumber.

* * * * *